US005929781A

United States Patent [19]

Vosika

[11] Patent Number: 5,929,781

[45] **Date of Patent: *Jul. 27, 1999**

[54] RADIO FREQUENCY CONTROLLED SYSTEM FOR TESTING EMERGENCY LIGHTING UNITS

[75] Inventor: David A. Vosika, Cloverdale, Va.

[73] Assignee: Hubbell Incorporated, Orange, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/576,558

[22] Filed: Dec. 21, 1995

[51] Int. Cl.[6] ..... G08B 29/00

[52] U.S. Cl. ..... 340/825.72; 340/825.69; 340/635; 340/641; 340/825.17; 315/134

[58] Field of Search ..... 340/825.72, 825.69, 340/825.16, 825.17, 635, 641; 315/130, 134, 86

[56] References Cited

U.S. PATENT DOCUMENTS

| | | | |
|---|---|---|---|
| 4,725,827 | 2/1988 | Gallegos et al. | 340/696 |
| 4,899,267 | 2/1990 | Mardon | 362/277 |
| 4,908,602 | 3/1990 | Reich et al. | 340/514 |
| 4,908,604 | 3/1990 | Jacob | 340/539 |
| 4,977,353 | 12/1990 | Helal et al. | 315/130 |
| 5,148,158 | 9/1992 | Shah | 340/825.17 |
| 5,154,504 | 10/1992 | Helal et al. | 362/20 |
| 5,365,145 | 11/1994 | Fields | 315/86 |

FOREIGN PATENT DOCUMENTS

| | | | |
|---|---|---|---|
| 0342579 | 5/1989 | European Pat. Off. | H02J 9/00 |
| 1567506 | 5/1980 | United Kingdom | H02J 9/00 |

*Primary Examiner*—V Lissi Mojica
*Assistant Examiner*—Yonel Beaulieu
*Attorney, Agent, or Firm*—Jerry M. Presson; Stacey J. Longanecker

[57] ABSTRACT

An system is provided for testing emergency lighting units using a receiver connected to the emergency lighting unit and a portable transmitter operable remotely with respect to the emergency lighting unit. The emergency lighting comprises a transfer relay for switching a battery between a primary power source and a lamp. A TEST button and the receiver each include a normally closed contact switch connected in series with each other, as well as with a primary power source input and transfer control circuitry. The transmitter generates encoded signals for wireless transmission to the receiver as long as a control switch on the transmitter is being activated by a user. The receiver receives and decodes the encoded signals and opens its normally closed relay as long as encoded signals are being received, causing the transfer control circuitry to activate the transfer relay to switch the battery from the primary power source to the lamp. The transmitter terminates transmission of encoded signals when the user deactivates the control switch. The receiver then closes its normally closed relay when encoded signals are no longer received, and the transfer control circuitry via the transfer relay switches the battery from the lamp to the primary power source for charging.

9 Claims, 7 Drawing Sheets

RADIO FREQUENCY CONTROLLED SYSTEM FOR TESTING EMERGENCY LIGHTING UNITS

FIELD OF THE INVENTION

The invention relates to a system for remotely controlling the switching of a battery in an emergency lighting unit between a primary power source and a lamp.

BACKGROUND OF THE INVENTION

Emergency lighting units (ELUS) are used to illuminate residential and commercial facilities in the event of a power outage. Most ELUs are connected to an alternating current (AC) line power source during normal operation, and charge a battery to power the lighting unit when AC line power is interrupted for a significant period of time. These units are typically tested on a periodic basis to ensure that the battery is being sufficiently charged and that the ELU will operate during AC power failure. Testing generally entails activating a test instrument on the housing containing the emergency lighting fixture. This presents difficulties for human operators because the ELUs are generally located in inaccessible areas such as on the walls and ceilings of residential and commercial buildings. Thus, testing can be an arduous, time-consuming task for human operators, particularly when a large number of ELUs is present in an installation such as a warehouse.

A number of systems have been developed to facilitate testing of ELUs. For example, U.S. Pat. No. 5,148,158 discloses an ELU having a remote testing capability. The lighting fixture is provided in a housing which is mounted on a ceiling, for example, and which encloses circuitry for receiving radio frequency control signals from a hand-held transmitter. The remote test function commences when a button on the transmitter unit is depressed by an operator. The transmitter unit generates first and second radio frequency (RF) signals which, when received by the receiver circuitry, cause a bi-stable relay in the housing to interrupt and continue, respectively, the supply of line power to the lighting fixture. In another embodiment, the generation of a momentary RF signal initiates the test function, that is, disconnects the lighting fixture from the line power source for a predetermined period of time, and operates the lighting unit from a battery, before connecting the line power source once again.

U.S. Pat. No. 5,154,504 discloses an emergency lighting system comprising a portable control unit which communicates with each of several lighting units via a two-way, infrared communications link. The portable control unit comprises Start Test and Stop Test buttons to start and stop a test function, respectively, whereby the lighting unit is disconnected from a primary power source and operated from an alternate source.

SUMMARY OF THE INVENTION

The present invention provides an ELU that is advantageous because it does not require two transmitted signals to commence and interrupt an ELU test function, nor does it limit the test function to a predetermined period of operation. In addition, it uses a minimal number of test instruments or control buttons, among other advantages.

The present invention also provides an ELU that is advantageous because it is capable of operating a lighting fixture from an auxiliary power supply for a continuous and variable amount of time. The variable amount of time depends on the amount of time an operator activates a push button switch on a portable transmitter unit which is designed to communicate with a remote lamp control receiver unit.

In accordance with an embodiment of the present invention, an emergency lighting system for testing emergency lighting units is provided comprising a lamp, a primary power source, a battery for supplying power to the lamp during primary power source interruption, a lamp control circuit connected to the lamp and battery, and a transmitter comprising a control switch that is operable remotely from the lamp control circuit to generate and transmit a control signal thereto The duration of the control signal corresponds to the amount of time the transmitter control switch is activated The lamp control circuit comprises a receiver operable to receive the control signal and transfer circuitry to switch the lamp to the battery. The lamp control circuit switches the battery from the primary power source to the lamp in response to receipt of the control signal, and switches the battery from the lamp to the primary power source for charging after a period of time has elapsed. The period of time corresponds to the duration of the control signal.

BRIEF DESCRIPTION OF THE DRAWINGS

These and other features and advantages of the present invention will be more readily apprehended from the following detailed description when read in connection with the appended drawings, which form a part of this original disclosure, and wherein.

DETAILED DESCRIPTION OF THE PREFERRED EMBODIMENT

Figure 1:
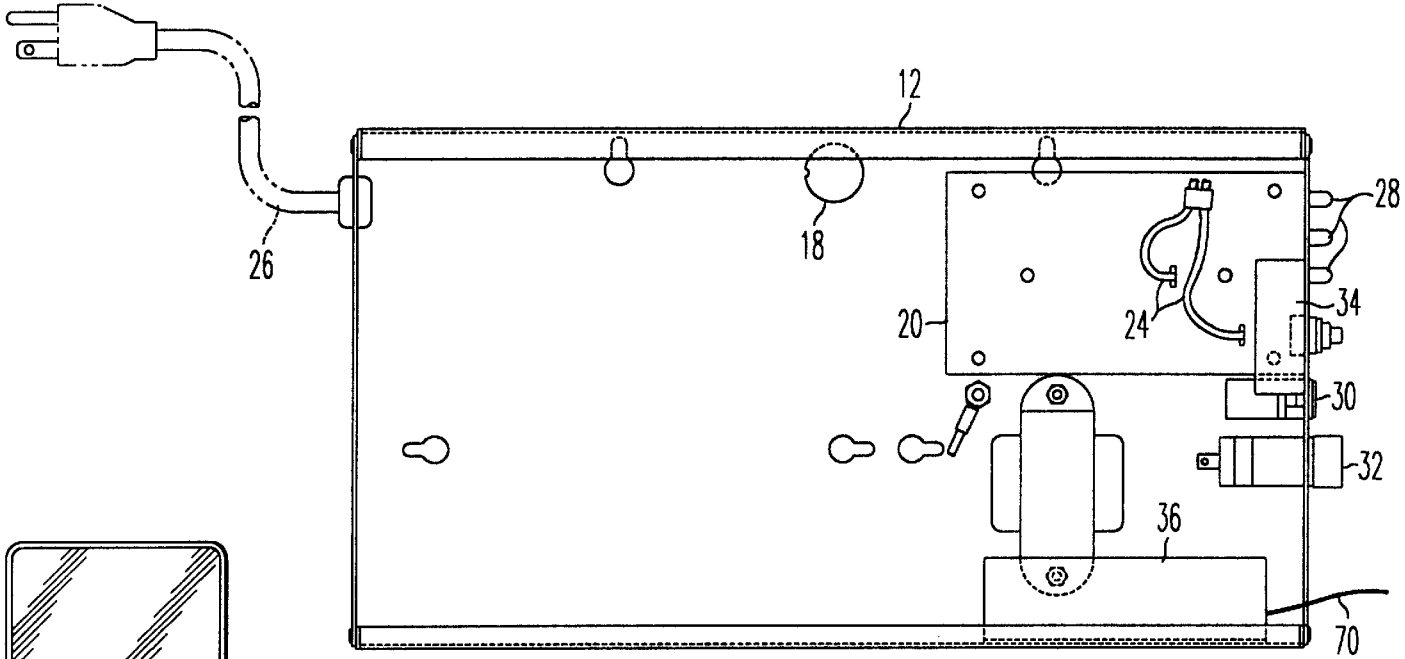
FIG. 1 is a front view of an emergency lighting unit with the front cover and lamp removed and comprising a receiver in accordance with an embodiment of the present invention.
Figure 3:
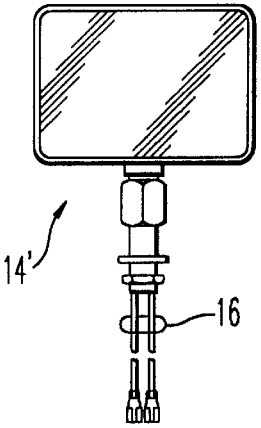
FIGS. 2 and 3 each illustrate two of several different types of lamps that can be mounted on the emergency lighting unit of FIG. 1.
Figure 2:
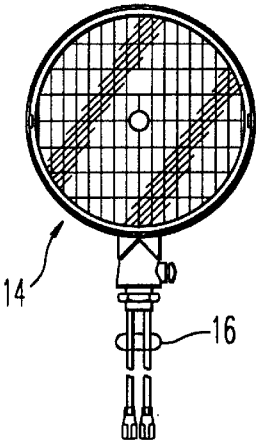
Figure 4:
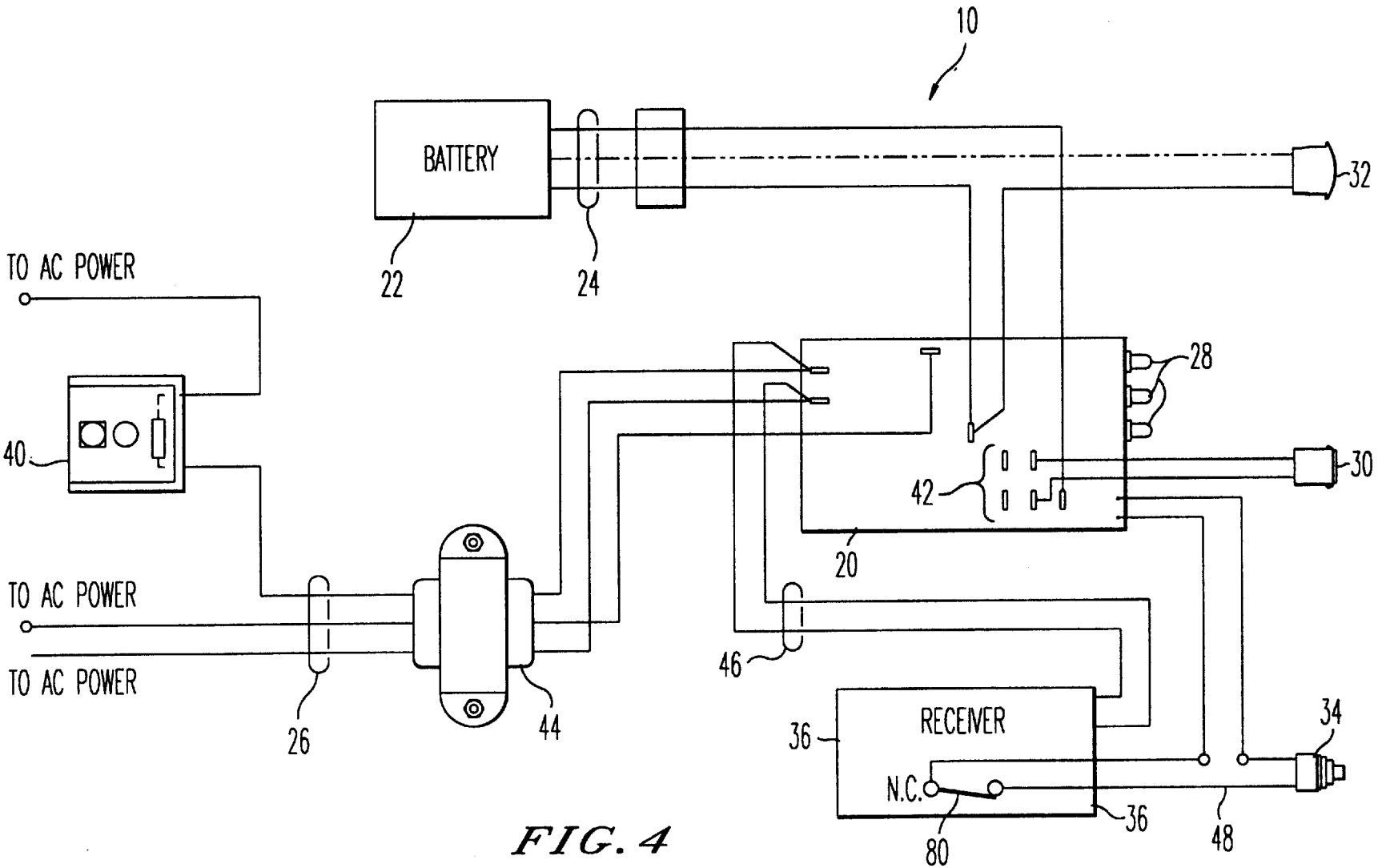
FIG. 4 is a schematic diagram of an emergency lighting unit connected to a receiver in accordance with an embodiment of the present invention.

FIG. 1 is a front view of an emergency lighting unit (ELU) 10 having the front cover (not shown) removed to reveal the contents of the unit housing 12. An incandescent or halogen lamp, such as those depicted at 14 and 14' in FIGS. 2 and 3, is mounted in a conventional manner on the top, front or sides of the housing 12 and the wires 16 are placed through an aperture 18 in the housing 12 in order to be connected to a charger board 20. With reference to FIG. 4, the housing 12 encloses a battery 22 which is connected to a charger board 20 via battery wires 24. The battery 22 is an alternate power source when current from an AC power source is not available on the AC line 26, or AC power has been interrupted intentionally to test the ELU, as will be described below.

With continued reference to FIG. 1, the charger board 20 carries light emitting diodes (LEDs) 28 which extend outside the housing 12 to indicate that the AC supply is present for the ELU, whether the ELU is in the battery backup mode (i.e., emergency operation mode) and to indicate the status of the battery (i.e., high or low charge). The housing 12 allows for mounting of an optional voltmeter 30 and an ammeter 32 that can be connected to the charger board 20. To test the operation of the ELU 10 on battery power, a TEST push button 34 is provided on the housing. When an operator depresses the button 34, the charger board 20 switches the lamp 14 from AC line to battery power. In accordance with an embodiment of the present invention, the ELU 10 can also be tested using a receiver 36, which is mounted in the ELU fixture housing 12, in conjunction with a hand-held transmitter depicted in FIGS. 6 and 7.

Figure 5:
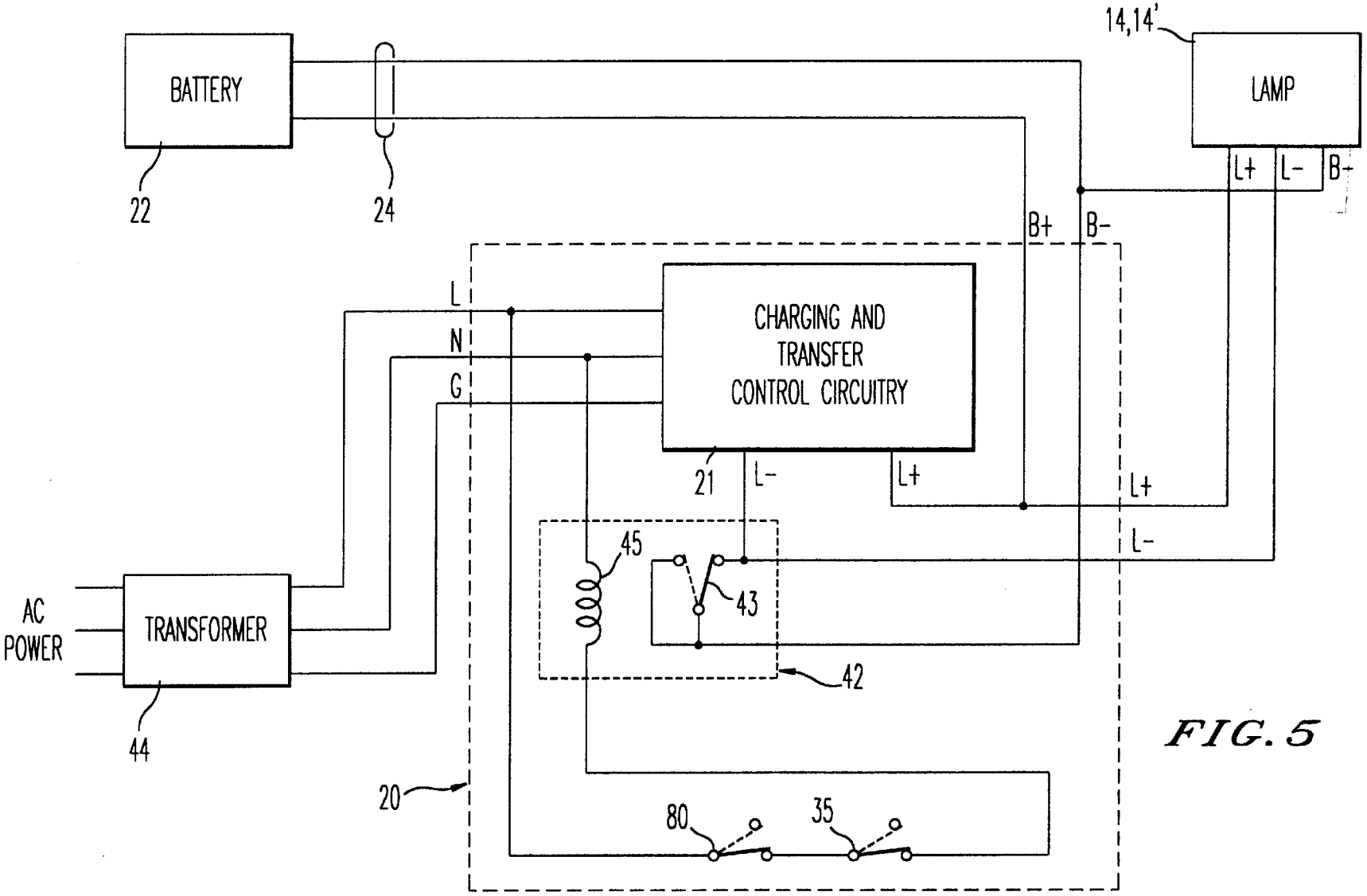
FIG. 5 is a schematic diagram of a charger board in a emergency lighting unit constructed in accordance with an embodiment of the present invention.

With reference to FIG. 4, the charger board 20 is connected to a primary power source via a transformer 44 and AC lines 26, to an alternate or auxiliary power source such as a battery 22, to a TEST button 34 and to a receiver 36. The charger board 20 can also be connected to an optional voltmeter 30, an ammeter 32 and to a time delay device 40. The charger board 20 is preferably a low voltage, low wattage Economy #703069 charger printed circuit board (PCB) manufactured by Hubbell Lighting Incorporated, Christiansburg, Va., which switches the lamp output on the negative lead of the battery, as shown in FIG. 5. The ELU 10 is preferably in a model PE612 or HE625 ELU, also manufactured by Hubbell Lighting Incorporated. It is to be understood that other ELUs can be used in accordance with the present invention. Further, other battery and charging assemblies can be used in accordance with the present invention such as the Hubbell low voltage, high wattage, #703067 emergency charger manufactured by Hubbell Lighting Incorporated, which switches the lamp output on the positive lead of the battery.

As shown in FIG. 5, the charger board 20 is of a conventional type and includes DC rectifying and voltage regulating and transfer control circuitry 21 for maintaining the battery 22 in a fully charged condition. The charger board 20 has four output terminals designated B+, B−, L+ and L−. The B+ and B− terminals are the battery terminals of the charger board and are connected to the positive and negative terminals of the battery 22, respectively. The L+ and L− terminals are the lamp output terminals of the charger board 20 and are connected to the lamp 14 or 14'. The B− terminal is also electrically connected to the lamp 14 or 14' via the PCB 20.

To switch between standby and emergency or test modes, the charger board 20 comprises transfer control circuitry 21 and a transfer relay and transistor (indicated generally at 42). The transfer control circuitry 21 operates the transfer relay and transistor 42 to selectively switch the lamp(s) to the battery power source in response to open circuit conditions due to activation of normally closed relays 35 and 80 by the TEST push button 34 and the receiver 36, respectively, or the condition of the loss of the primary AC power source. The transfer relay 43 has a coil 45 which is coupled to the transfer control circuitry 21. When AC power is available, the relay contacts of relay 43 are in an unswitched position to prevent the lamp polarities from being electrically connected to the battery output terminals B+ and B−. This condition allows for the charging and transfer circuit 21 to maintain the battery in a fully charged condition during the standby mode. When the AC power is interrupted or falls below a predetermined level, the transfer control circuitry 21 energizes the coil 45 and allows the relay 43 to go to a switched position. The lamp terminals are therefore electrically connected to the battery terminals. The isolation between the lamp terminals and the battery terminals can also be accomplished using a power transistor. Thus, the relay 43 or a power transistor operates as a transfer switch for automatically initiating emergency or test mode operation in the event of a power supply interruption, and for automatically returning the ELU 10 to standby operation once power has been restored.

With continued reference to FIG. 4, the ELU 10 also comprises a transformer 44 for stepping down the voltage from the primary power source (e.g., a 120 VAC power supply) to a reduced input voltage (e.g., an input voltage range of 10 VAC minimum and 35 VAC maximum). The input voltage is used to power the receiver 36, as indicated by lines 46, and is used to charge the battery when the ELU is not in an emergency or test mode.

In accordance with an embodiment of the invention, the TEST button 34 and the receiver 36 each include a normally closed contact switch and are connected in series with each other, as well as with the power supply input transfer control circuitry 21 of charger board 20. When either the TEST button 34 (e.g., a momentary push button) or the receiver 36 is activated and opens its normally closed switch, the supply of input current from the primary power source is interrupted The transfer control circuitry of the charger board 20 detects an open circuit condition on the serial line 48 and, accordingly, switches the transfer relay transistor to operate the lamp from the battery.

Figure 6:
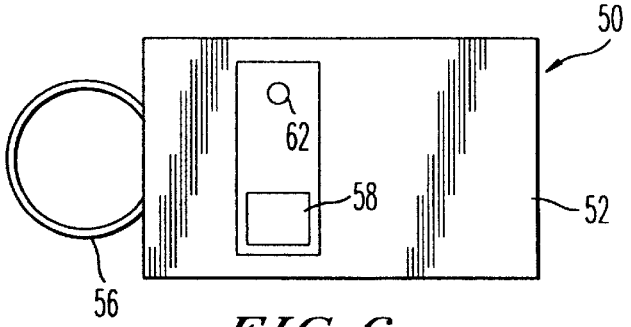
FIGS. 6 and 7 are front and side views, respectively, of a remote transmitter constructed in accordance with an embodiment of the present invention.
Figure 7:
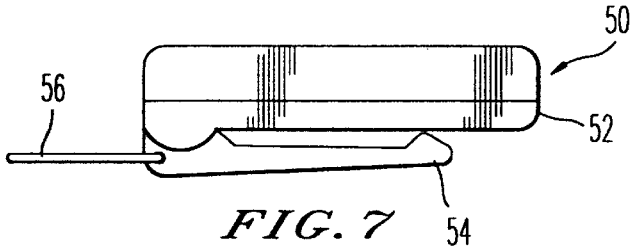

The receiver 36 is activated by a transmitted radio frequency (RF) signal generated by the hand-held transmitter 50 depicted in FIGS. 6 and 7. The transmitter preferably comprises a plastic-molded housing 52 having a belt clip 54 and a key ring 56. The transmitter housing 52 encloses a battery and a transmitter control circuit as described below in connection with FIGS. 8 and 10. A momentary push button switch 58 is provided such that when it is activated by a user, the transmitter generates a RF control signal via an antenna 60 (FIG. 8) for transmission to the receiver 36 for essentially as long as the user activates the switch 58. An LED 62 or other indicator is provided to indicate when the transmitter 50 is generating and transmitting a control signal to the receiver 36.

Figure 8:
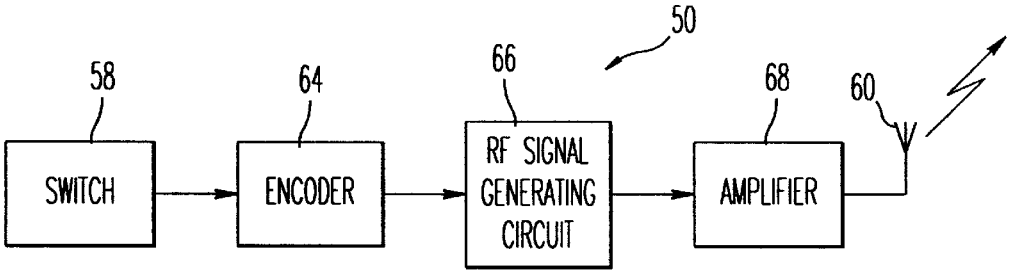
FIGS. 8 and 9 are block diagrams of a transmitter and a receiver, respectively, constructed in accordance with an embodiment of the present invention.

With reference to FIG. 8, the transmitter 50 comprises an encoder 64 for generating an encoded signal for as long as the button 58 is depressed by a user. The encoder 64 is connected to a RF signal generating circuit 66 for combining the encoded signal with a RF carrier signal. The encoded RF signal is amplified by an amplifier 68 and broadcast to the lamp control circuit via the antenna 60. The RF signal generating circuit 66, amplifier 68, and antenna 60 can be an LC oscillator 92 as described in connection with FIG. 10. It is to be understood that other wireless for communicating with the lamp control unit can be used. For example, the transmitter can be provided with circuitry for modulating the encoded output signal from the encoder into an infrared signal or ultrasonic signal. The receiver in the lamp control unit can be provided with corresponding circuitry for receiving encoded infrared or ultrasonic signals.

Figure 9:
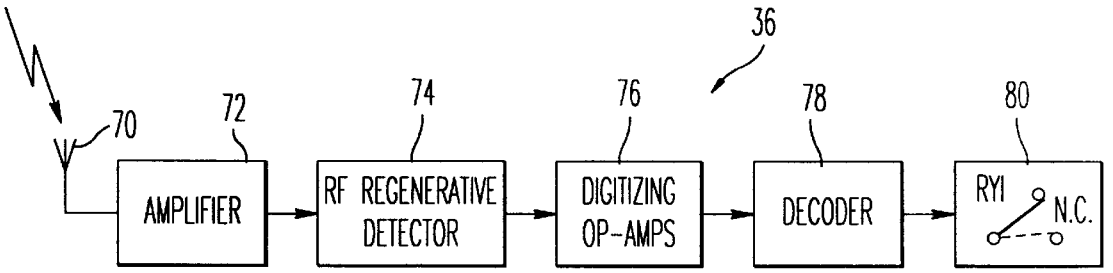

With reference to FIG. 9, the receiver 36 comprises an antenna 70 for receiving encoded RF signals from the transmitter 50. The RF signals are processed by an amplifier 72 and then demodulated into digital signals by a RF regenerative detector 74, which is tuned to the transmitter frequency, and digitizing operational amplifiers 76. The digital signals are decoded by a decoder 78, which opens the normally closed relay 80 to interrupt the primary power supply if the decoded signals are recognized as valid control signals from the transmitter 50. The charger board 20 in turn energizes the transfer relay and transistor 42, thus connecting the lamp 14 or 14' to the battery An advantage of placing the receiver relay 80 in series with the manual TEST button 34 and of using normally closed contacts on the relay 80 is that the ELU 10 remains operational and continues to have a manual test function via TEST button 34 even if the transmitter 50 or receiver 36 malfunction.

Figure 10:
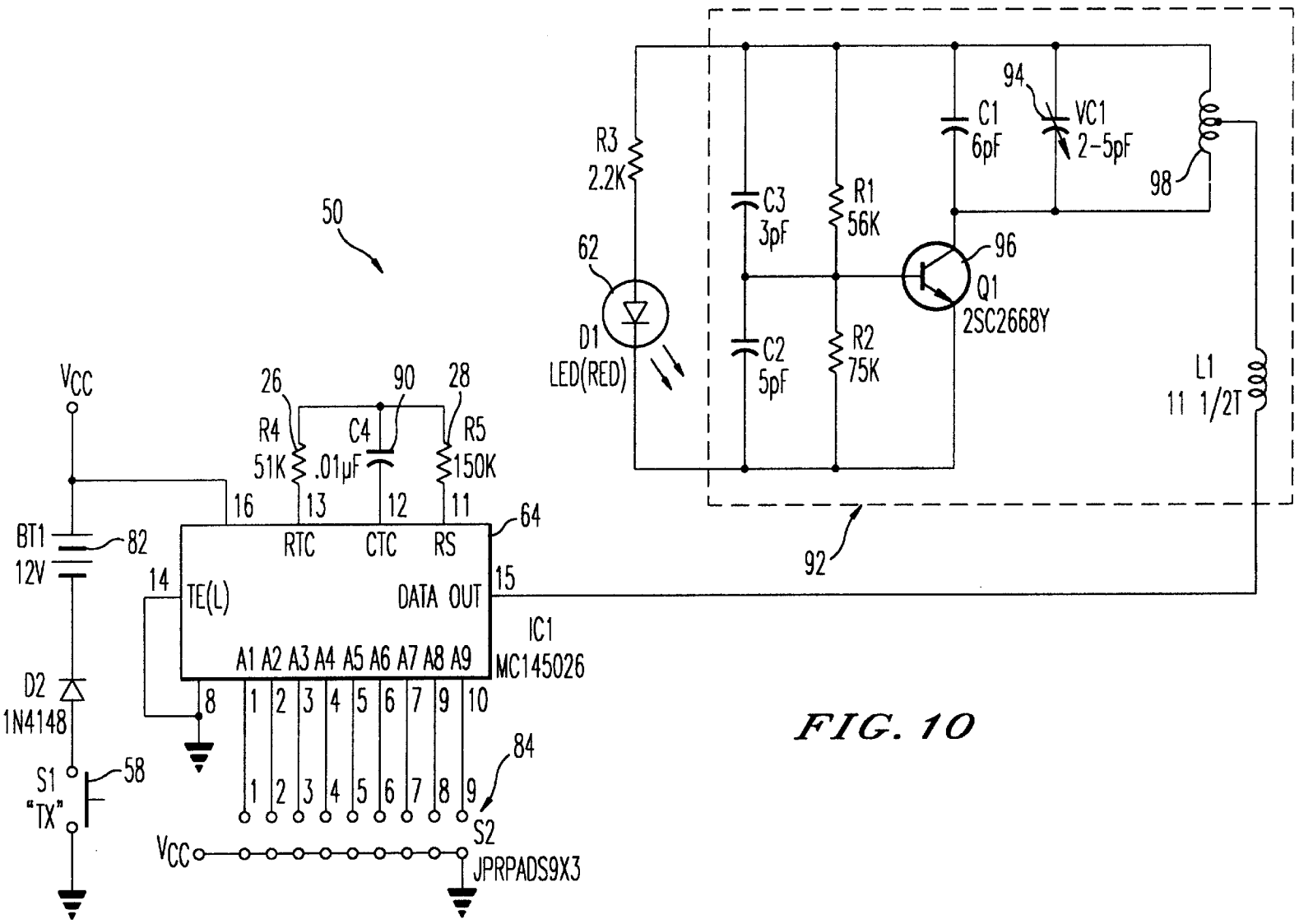
FIGS. 10, 11A and 11B are schematic diagrams of a transmitter and a receiver, respectively, constructed in accordance with an embodiment of the present invention.

The encoding and decoding processes will now be described with reference to FIGS. 10 and 11, which are schematic diagrams of the transmitter 50 and receiver 36, respectively As shown in FIG. 10, the transmitter 50 comprises a battery 82 which supplies a voltage Vcc to the encoder 64 as long as the switch 58 is closed. The switch BT1 58 can be a push button-type switch that must be pressed and held to remain closed. Enable pin 14 on the encoder 64 is tied to ground such that the encoder is enabled as long as it is receiving a supply voltage. The encoder 64 comprises nine pins (i.e., A1 through A9) and is configured to generate one of three different output signals on pin 15 depending on which the nine pins are tied to Vcc, to ground, or are left floating, respectively. For example, the encoder 64 can be configured to generate two wide pulses for each pin connected to Vcc, one wide pulse and one narrow pulse for each pin connected to ground, and two narrow pulses for each pin left floating to create an encoded output signal of eighteen, serial pulses. A three-position switch or jumper 84 can be used to set each pin to a Vcc, ground or floating state. The switch settings can be varied among several transmitters and, correspondingly, among receivers configured to recognize a particular pattern of eighteen, wide and narrow pulses in a received signal. Varying the switch settings reduces the likelihood of unintended reception of transmitted signals by the wrong ELU or other wireless device (e.g., a security device or automatic door in the vicinity of the ELU 10).

With continued reference to FIG. 10, the resistors 86 and 88 and the capacitor 90 connected to the encoder 64 are selected to establish a predetermined rate of pulses output on pin 15. When a pulse appears on pin 15, an LC oscillator 92 begins oscillating at a tuned frequency (e.g., 318 MHz) for the duration of the wide or narrow pulse. The tuned frequency is preferably selected from a range of frequencies between 286 and 370 MHz and tuning is performed by varactor 94. Thus, one of the RF pulses in an encoded signal is generated by the oscillator 92 for transmission to the receiver 36. When no pulse appears on pin 15 of the encoder 64, the transistor 96 turns the coil 98 off until the next wide or narrow pulse appears at the pin 15. After eighteen pulses appear on the pin 15, the encoder 64 generates six synchronization pulses before generating the next sequence of eighteen pulses. The LED 62 is illuminated each time a RF pulse is transmitted. The LED 62 becomes dim as battery charge decreases and therefore functions as an indicator to replace the transmitter battery 82.

Figure 11A:
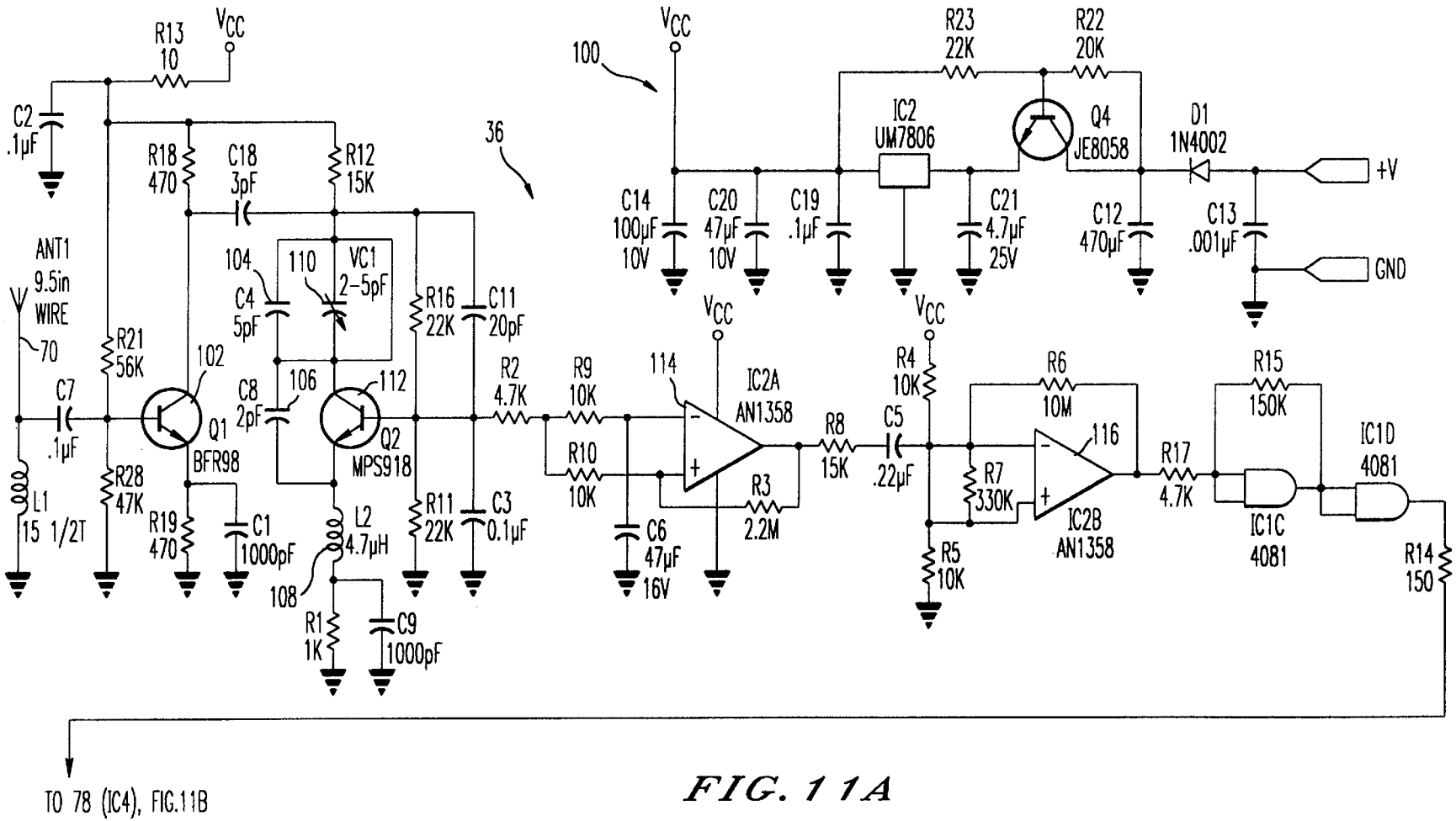
Figure 11B:
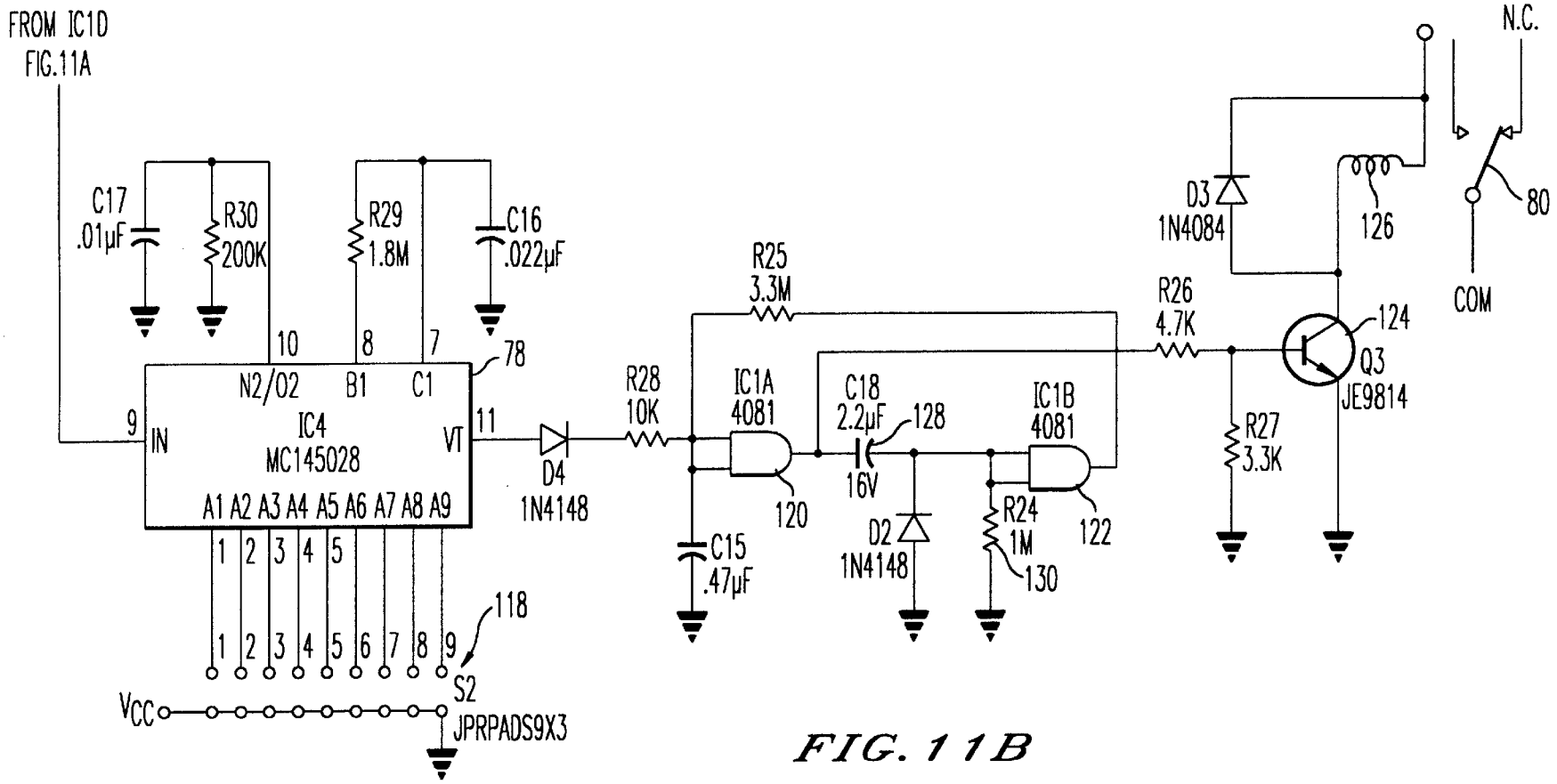

With reference to FIG. 11, a conventional power supply is provided within the receiver 36 for converting the voltage from the secondary of the transformer 44. The receiver 36 comprises an antenna 70 and an amplifier (i.e., transistor 102) for amplifying a received RF pulse in an encoded signal. When a RF pulse is received that is tuned to the same frequency as the RF regenerative detector 74 (i.e., a tuner comprising capacitors 104 and 106, inductor 108, varactor 110 and transistor 112), the regenerative detector 74 changes the amplitude of its oscillating output signal such that the signal can be converted to a square wave, digital signal by the operational amplifiers 114 and 116. The digital signal at the output of the operational amplifier 116 is provided to the decoder 78.

With continued reference to FIG. 11, the decoder 78 compares the input digital signal at pin 9 with switch data at pins A1 through A9, which are configured in a manner identical to the transmitter using three-position switches or jumpers 118, as described above. When the decoder 78 detects two identical encoded signals of eighteen pulses, which are separated by a synchronization signal of six pulses, the decoder generates a high output signal at pin 11. The pin 11 remains high, as long as valid encoded signals are detected by the decoder 78. The decoder output signal is provided to the relay 80 via gates 120 and 122 and transistor 124. A high output signal causes the transistor 124 to conduct and operate the relay coil 126 to open a normally closed contact. Accordingly, the charger board 20 switches the lamp 14 or 14' to the battery 22 to operate the ELU 10 in a test mode. When the output signal at pin 11 then goes low, the transistor 124 turns off, and the relay closes. The charger board 20 disconnects the lamp 14 or 14' from the battery 22.

When valid encoded data is being received, the relay 80 remains open until encoded pulse signals are no longer detected by the decoder 78, even if there is a momentary loss of data (e.g., the transmitter user unintentionally breaks contact of switch S1 for an instant). Protection against momentary, unintentional loss of encoded data is provided by the second gate 122. Since the output signal from the second gate 122 is required at one input of the first gate 120, gate 122 establishes a minimum time for providing an output signal from the decoder 78 to the first gate 120 that has not changed state (i.e., changed from high to low, or low to high). Capacitor 128 and resistor 130 are selected to set the predetermined minimum time for providing a signal to the first gate without changing state to a desired value (e.g., two seconds). Conversely, if the button 58 on the transmitter 50 is depressed for only a brief period of time (e.g., one second), the test feature is engaged (i.e., a high decoder output signal is generated to open the relay 80) for the minimum time of two seconds.

The present invention is advantageous because, among other reasons, it does not require two transmitted signals to commence and interrupt, respectively, an ELU 10 test function. An emergency lighting system is provided, in accordance with an embodiment of the present invention, with a receiver 36 connected to an ELU 10 and a portable transmitter 50 operable remotely with respect to the ELU. The transmitter 50 is configured to generate and transmit a single encoded signal to the receiver 36 as long as a switch 58 on the transmitter is activated by the user. The switch 58 can be of the type which must be depressed and held to continue generation of the encoded signal, or of the type which is depressed once to commence encoded signal generation and depressed once more to terminate encoded signal generation. The receiver 36 receives and decodes the transmitted signal and opens a normally closed relay 80 as long as the signals are being received. The battery 22 in turn is disconnected from the primary power source and connected to the lamp 14 or 14'. When the transmitter 50 discontinues generation and transmission of encoded signal to the receiver 36 (i.e., the switch 58 is no longer activated), the receiver closes the normally closed switch 80. The battery 22 in turn is reconnected to the primary power source for recharging. The emergency lighting control system therefore can remotely control the normally closed switch 80 and, therefore, the switching of the battery between the primary power source and the lamp 14 or 14' using only one transmitted signal and one switch 58 on the transmitter, thereby reducing the complexity of the transmitter and the receiver. Further, the time during which the lamp is operating from an auxiliary power source (e.g., battery 22) can be continuous and variable depending on how a user operates the switch 58 on the transmitter 50. The test mode, therefore, is not limited to a predetermined period of time, as in some systems for testing ELUs wherein a momentary RF signal initiates a test function using an auxiliary power source such as a battery to power a lamp for a predetermined period of time before reconnecting the battery to the primary power source.

While certain advantageous embodiments have been chosen to illustrate the invention, it will be understood by those skilled in the art that various changes and modifications can be made herein without departing from the scope of the invention as defined in the appended claims. For example, the charging board 20, test button 34 and receiver 36 can be designed such that the lamp is switched from a primary power source to an auxiliary power source such as the battery 22 when a normally open switch is closed in response to the test button being activated or a transmitter signal is received.

What is claimed is:

1. An emergency lighting system comprising:

a lamp;

a primary power source for supplying power to said emergency lighting system;

a transformer having a primary winding connected to said primary power source and a secondary winding;

a battery for supplying power to said lamp when said battery is not connected to said primary power source;

a lamp control circuit connected to said lamp, said battery and said primary power source via said secondary winding; and a transmitter comprising a control switch and operable remotely from said lamp control circuit to generate and transmit a control signal thereto, the duration of said control signal corresponding to the amount of time said control switch is activated;

said lamp control circuit comprising a receiver operable to receive said control signal, a power transfer switch, and a receiver switch, said receiver switch being connected in series with said power transfer switch, said receiver switch and said power transfer switch being connected in parallel with respect to said secondary winding, said receiver switch being operated by said receiver in response to said control signal to control the supply of power from said secondary winding to said power transfer switch to selectively activate and deactivate said power transfer switch and connect said battery to one of said lamp and said primary power source, said lamp control circuit being operable to switch said battery from said primary power source to said lamp via said power transfer switch in response to receipt of said control signal by said receiver and activation of said receiver switch by said receiver, and for switching said battery from said lamp to said primary power source via said power transfer switch for charging after a period of time has elapsed, said period of time corresponding to the duration of said control signal.

2. An emergency lighting system as claimed in claim 1, wherein said control signal is of an electromagnetic signal type selected from the group consisting of a radio frequency signal, an infrared signal, and an ultrasonic signal, said transmitter and said receiver being configured to generate and receive, respectively, said an electromagnetic signal type.

3. An emergency lighting system as claimed in claim 1, wherein said transmitter is portable.

4. An emergency lighting system as claimed in claim 1, wherein said power transfer switch comprises a relay and a coil for switching the relay when energized, said coil being connected in series with respect to said receiver switch and said coil and said receiver switch being connected in parallel with respect to said secondary winding, said coil being activated to switch said relay between first and second states in accordance with receipt of said control signal and corresponding activation of said receiver switch to selectively interrupt the supply of power from said secondary winding to said coil to operate said relay.

5. An emergency lighting system as claimed in claim 1, wherein said control switch is a momentary push button switch.

6. An emergency lighting system as claimed in claim 1, wherein said control switch is configured to be manually activated by an operator.

7. An emergency lighting system as claimed in claim 6, wherein the duration of said control signal corresponds to the amount of time said control switch is activated by said operator, and the duration of said period of time for connecting said battery to said lamp corresponds to said amount of time said control switch is activated by said operator.

8. A method for remotely controlling the switching of a battery between a primary power source and a lamp, the primary power source having a transformer with a primary winding and a secondary winding, the method comprising the steps of:

activating a transmitter switch on a transmitter remotely located with respect to said lamp for a period of time selected from the group consisting of a predetermined period of time and a variable period of time;

generating a control signal having a duration corresponding to said period of time using said transmitter;

transmitting said control signal from said transmitter to a receiver having a receiver switch connected in series with a power transfer switch and connected together with said power transfer switch in parallel with respect to said secondary winding;

receiving said control signal using said receiver;

switching said receiver switch to control the supply of power from said secondary winding to said power transfer switch;

switching said battery from said primary power source to said lamp via said power transfer switch upon activation thereof by said receiver switch following receipt of said control signal;

deactivating said transmitter switch;

terminating said generating, transmitting and receiving steps;

deactivating said power transfer switch by switching said receiver switch; and transferring said battery from said lamp to said primary power source via said power transfer switch for charging when said control signal is no longer received.

9. An emergency lighting system comprising:

a lamp;

a primary power source for supplying power to said emergency lighting system;

a transformer having a primary winding connected to said primary power source and a secondary winding;

a battery for supplying power to said lamp when said battery is not connected to said primary power source;

a lamp control circuit connected to said lamp, said battery and said primary power source via said secondary winding; and a transmitter comprising a control switch and operable remotely from said lamp control circuit to generate and transmit a control signal thereto, the duration of said control signal corresponding to the amount of time said control switch is activated;

said lamp control circuit comprising a receiver operable to receive said control signal, a power transfer switch, and a receiver switch, said receiver switch being operated by said receiver in response to said control signal for controlling the supply of power from said secondary winding to said power transfer switch to selectively activate and deactivate said power transfer switch and connect said battery to one of said lamp and said primary power source, said lamp control circuit being operable to switch said battery from said primary power source to said lamp via said power transfer switch in response to receipt of said control signal by said receiver and activation of said receiver switch by said receiver, and for switching said battery from said lamp to said primary power source via said power transfer switch for charging after a period of time has elapsed, said period of time corresponding to the duration of said control signal;

wherein said power transfer circuit comprises a relay and a coil for switching the relay when energized, said coil being activated to switch said relay between first and second states in accordance with receipt of said control signal and corresponding activation of said receiver switch; and wherein said battery comprises a first terminal connected to said lamp and to one of a first conductor and a second conductor extending from said secondary winding and a second terminal, said relay comprises a first contact and a second contact, said second terminal of said battery is connected to said relay and to said lamp, said first contact is connected to whichever one of said first conductor and said second conductor from said secondary winding that is not connected to said first terminal of said battery and said second contact is connected to said second terminal of said battery, and said receiver switch and said coil are connected in series with respect to each other and in parallel with respect to said secondary winding, said lamp control circuit being configured to switch said relay to said first state by opening said receiver switch and deenergizing said coil to switch said relay to said second contact and thereby switch said battery from said primary power source to said lamp, and to switch said relay to said second state by closing said receiver switch and energizing said coil to switch said relay to said first contact and switch said battery from said lamp to said primary power source.

* * * * *